US006849840B2

(12) United States Patent
Sung

(10) Patent No.: US 6,849,840 B2
(45) Date of Patent: Feb. 1, 2005

(54) MICROWAVE OVEN WITH INVERTER AND COOLING ASSEMBLY

(75) Inventor: Gi Young Sung, Changwon-si (KR)

(73) Assignee: LG Electronics Inc., Seoul (KR)

( * ) Notice: Subject to any disclaimer, the term of this patent is extended or adjusted under 35 U.S.C. 154(b) by 22 days.

(21) Appl. No.: 10/612,021

(22) Filed: Jul. 3, 2003

(65) Prior Publication Data

US 2004/0016751 A1 Jan. 29, 2004

(30) Foreign Application Priority Data

Jul. 26, 2002 (KR) ..... 10-2002-44267
Jul. 26, 2002 (KR) ..... 10-2002-44268
Jul. 26, 2002 (KR) ..... 10-2002-44269

(51) Int. Cl.[7] ..... H05B 6/80
(52) U.S. Cl. ..... 219/757; 219/758; 126/21 A
(58) Field of Search ..... 219/757, 758, 219/681, 400, 702, 715; 126/21 A, 21 R

(56) References Cited

U.S. PATENT DOCUMENTS 5,393,961 A * 2/1995 Umekage et al. ..... 219/757
6,150,648 A * 11/2000 Kang et al. ..... 219/757
6,414,287 B2 * 7/2002 Han et al. ..... 219/715

FOREIGN PATENT DOCUMENTS

JP 1-221881 * 9/1989 ..... 219/757

* cited by examiner

*Primary Examiner*—Philip H. Leung
(74) *Attorney, Agent, or Firm*—Fleshner & Kim, LLP

(57) ABSTRACT

Microwave oven including a main cabinet having a plurality of air inlet openings and a plurality of air outlet openings, for accommodating and protecting various components, an inner case provided in an upper space of the main cabinet to form a cooking chamber therein, the inner case having a plurality of inlet holes and outlet holes, an outfit chamber in a rear part of a lower space of the main cabinet for fitting electronic components therein, an inverter part in a front part of a lower space of the main cabinet, a magnetron part in a side space of the main cabinet, partition plates for separating a space for the inverter part, a space of the outfit chamber, and a space for the magnetron, respectively, and a single fan device in a part in contact with the spaces in common for circulating external air to the spaces in the main cabinet, thereby cooling the outfit chamber and the magnetron as well as preventing moisture in a cavity by using only one cooling fan and a fan motor.

35 Claims, 12 Drawing Sheets

MICROWAVE OVEN WITH INVERTER AND COOLING ASSEMBLY

This application claims the benefit of the Korean Application Nos. P2002-0044267, P2002-0044268, and P2002-0044269, filed on Jul. 26, 2002, which are hereby incorporated by reference.

BACKGROUND OF THE INVENTION

1. Field of the Invention

The present invention relates to microwave ovens, and more particularly, to an air circulating structure in a microwave oven for cooling components of the microwave oven.

2. Description of the Related Art

In general, the microwave oven (MWO) disturbs molecular arrangement of microwave (approx. 2,450 MHz), to heat the food with a heat from friction between molecules caused by the disturbance.

In general, the microwave oven is provided with a main cabinet 10 having a base plate 11, an outer case 12, and a rear panel 13, an inner case 20 having a cooking chamber therein, and an outfit chamber 30 for fitting various electronic components.

FIG. 1 illustrates a related art microwave oven having the outfit chamber 30 under the inner case 20, schematically. In general, the components of a microwave oven generate much heat, which is cooled with air supplied from an exterior. However, uniform circulation of air throughout an entire space, which is divided into an upper space and a lower space, of the microwave oven is difficult practically. Consequently, an optimal air circulating structure is required. Such an air circulating structure will be described in detail.

Referring to FIG. 2, basically, the air circulating structure in the related art microwave oven is provided with two cooling fans 41 and 42 provided in a front part of a bottom of the base plate 11. One of the cooling fans ("a first cooling fan") 41 cools various electronic components 31, and the other one of the cooling fan ("a second cooling fan") 42 blows air to a magnetron 50 and into the inner case 20. The cooling fans 41 and 42 are driven by fan motors 41*a* and 42*a*, and a partition plate 60 separates a flow path of the air blown from the cooling fans 41 and 42.

There are a plurality of slits of air inlet openings 11*a* in a front part of the base plate 11, and as shown in FIGS. 1 and 5, a plurality of air outlet openings 13*a* and 13*b* in an upper part and a lower part of the rear panel 13. Air having cooled the various components 31 is discharged through the lower air outlet openings ("a first air outlet) 13*a*, and air having circulated through an inner case 20 is discharged through the upper air outlet openings ("second of outlet openings) 13*b*.

Referring to FIGS. 3 and 4, there are a plurality air inlet holes 21 in one side wall surface of the inner case 20, and a plurality of air outlet holes 22 in an upper surface of the inner case 20. There is a cover part 23 over the inner case 20, which also serves as a guide passage of the air from the air outlet holes 22 to the second air outlet openings 22.

A process of air circulation in the related art microwave oven will be described in more detail.

When the microwave oven is put into operation, one pair of the cooling fans 41 and 42 are driven, to draw external air. Drawn external air is introduced into a space the cooling fans a provided thereto through the air inlet openings 11*a*, and discharged to the outfit chamber 30 and a space the magnetron 50 is provided therein through independent flow passages by the first cooling fan 41 and the second cooling fan 42, respectively.

The air blown by the first cooling fan 41 flows through the outfit chamber 30, and cools the various electronic components 31, and is discharged to an outside of the main cabinet 10 through the first air outlet opening 13*a*.

Referring to FIG. 3, the air blown by the second cooling fan 42 passes through, and cools the magnetron 50. Then, referring to FIG. 4, the air flows through an inside of the inner case 20 through air inlet holes 21 in the wall surface of the inner case 20.

Then, the air is discharged to an outside of the inner case 20 through the air outlet holes 22, guided by the cover part 23, and discharged to an outside of the main cabinet 10 through the second air outlet openings 13*b* in the rear panel.

However, the related art microwave oven has the following problems.

First, the air circulation structure of the related art microwave oven requires a plurality of cooling fans 41 and 42 and fan motors 41*a* and 41*b* for cooling the electronic components and removal of moisture from the cooking chamber, resulting in a complicate structure and high cost.

Second, the mounting of the fan motors 41*a* and 42*a* and the cooling fans 41 and 42 in the front part of the main cabinet 10 causes direct transmission of unpleasant noise to the user.

Third, currently application of an inverter to microwave oven becomes wider gradually for varying an output of the microwave from the magnetron. However, the inverter increases overheating and damaging the various components in the microwave oven because the inverter is controlled such that the magnetron is in operation at a high power continuously. Particularly, the overheating of the inverter may cause a serious damage to various circuits. Thus, a microwave oven having the inverter applied thereto requires a structure for smooth cooling of the inverter, without fail.

Fourth, there may be serious damage to the various electronic components caused by overheating coming from a sharp temperature rise of the inverter when the microwave oven stops together with the fans which cool an inside of the microwave oven when the heat in the inverter can not be dissipated.

SUMMARY OF THE INVENTION

Accordingly, the present invention is directed to a microwave oven that substantially obviates one or more of the problems due to limitations and disadvantages of the related art.

An object of the present invention is to provide a microwave oven which has a more efficient air circulation structure.

Another object of the present invention is to provide a microwave oven which has an air circulation structure that has less noise.

A further object of the present invention is to provide a microwave oven which has an air circulation structure for cooling an inverter more efficiently.

Additional features and advantages of the invention will be set forth in the description which follows, and in part will be apparent to those having ordinary skill in the art upon examination of the following or may be learned from practice of the invention. The objectives and other advantages of the invention will be realized and attained by the structure particularly pointed out in the written description and claims hereof as well as the appended drawings.

To achieve these objects and other advantages and in accordance with the purpose of the present invention, as embodied and broadly described herein, the microwave oven includes a main cabinet having a plurality of air inlet openings and a plurality of air outlet openings, for accommodating and protecting various components, an inner case provided in an upper space of the main cabinet to form a cooking chamber therein, the inner case having a plurality of inlet holes and outlet holes, an outfit chamber in a rear part of a lower space of the main cabinet for fitting electronic components therein, an inverter part in a front part of a lower space of the main cabinet, a magnetron part in a side space of the main cabinet, partition plates for separating a space for the inverter part, a space of the outfit chamber, and a space for the magnetron respectively, and a single fan device in a part in contact with the spaces in common for circulating external air to the spaces in the main cabinet.

The air inlet openings are formed in a bottom surface, and a rear surface of a rear part of the main cabinet, to be in communication with the outfit chamber. The air inlet openings are a plurality of slits.

The air outlet openings are formed in a rear surface of the main cabinet. The air outlet openings arc formed adjacent to the outlet holes in the inner case.

The microwave oven further includes a frame between the rear surface of the main cabinet and the inner case for prevention of re-introduction of the air passed through the outlet holes into an inside of the main cabinet.

The air outlet openings are formed in a side surface of the main cabinet, and the air outlet openings are formed to be in communication with the inverter part. The air outlet openings are formed in a side surface of front part of the main cabinet.

The inlet holes in the inner case are formed to be in communication with the space for the magnetron part, and the inlet holes in the inner case are formed in a side wall surface of the inner case adjacent to the space for the magnetron part.

The inner case further includes supplementary outlet holes in an upper surface of the inner case. The microwave oven further includes air outlet openings in an upper surface of rear part of the main cabinet for discharging the air discharged through the supplementary outlet holes.

The microwave oven further includes a frame projected from a bottom circumference of the inner case, to separate a space of the main cabinet into a lower space and an upper space, horizontally. The frame has an opening in a part adjacent to the inlet holes in the inner case.

The microwave oven further includes a frame projected from a top circumference of the inner case to form a space between the main cabinet and the inner case, additionally.

The microwave oven further includes a lamp part in a part the inlet holes are formed therein for illuminating an inside of the inner case. The lamp part includes a lamp, and a holder for holding the lamp and guiding the air to the inlet holes.

The microwave oven further includes a sensor part provided to the outlet holes for detecting a moisture content of outlet air.

The magnetron part includes a magnetron for emitting a microwave, and a housing projected toward a side surface of the main cabinet for protecting the magnetron and separating a side space of the main cabinet into a front space in communication with the inlet holes in the inner case and a rear space. The housing blocks a gap between a sidewall of the inner case and a sidewall of the main cabinet.

The fan device includes a fan for blowing air to the space for the inverter part and the space for the magnetron at the same time, and a fan motor for driving the fan. The fan is located in a rear part of the lower space of the main cabinet, and the fan blows air both to the space for the inverter and the space for magnetron, partially.

The partition plates include a first partition plate provided in a width direction to separate the space for the inverter part and the space of the outfit chamber, and a second partition plate provided in a length direction for partition the space for the magnetron. The partition plates further include a third partition plate provided in parallel to the first partition plate for forming an air passage to the space for the inverter part. The fan is provided to a part the first and second partition plates cross.

The microwave oven further includes a flow guide formed in the space for the inverter part for guiding an air flow. An air discharge passage from the inverter part includes air outlet openings in a bottom surface of a front part of the main cabinet, and the flow guide is sloped for guiding air flow to the air outlet openings.

The flow guide has a predetermined curvature. A plurality of flow guides are provided. The flow guides have different heights. The heights of the flow guides become the lower as it goes the farther toward a side the inverter part is provided.

The air discharge passage from the inverter part further includes air outlet openings in a side surface of a front part of the main cabinet.

It is to be understood that both the foregoing description and the following detailed description of the present invention are exemplary and explanatory and are intended to provide further explanation of the invention claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE PREFERRED EMBODIMENT

Reference will now be made in detail to the preferred embodiments of the present invention, examples of which are illustrated in the accompanying drawings. In describing the embodiments of the present invention, same parts will be given the same names and reference symbols, and repetitive description of which will be omitted. Preferred embodiments of a microwave oven of the present invention will be described with reference to FIGS. 6~12, in detail.

Figure 1:
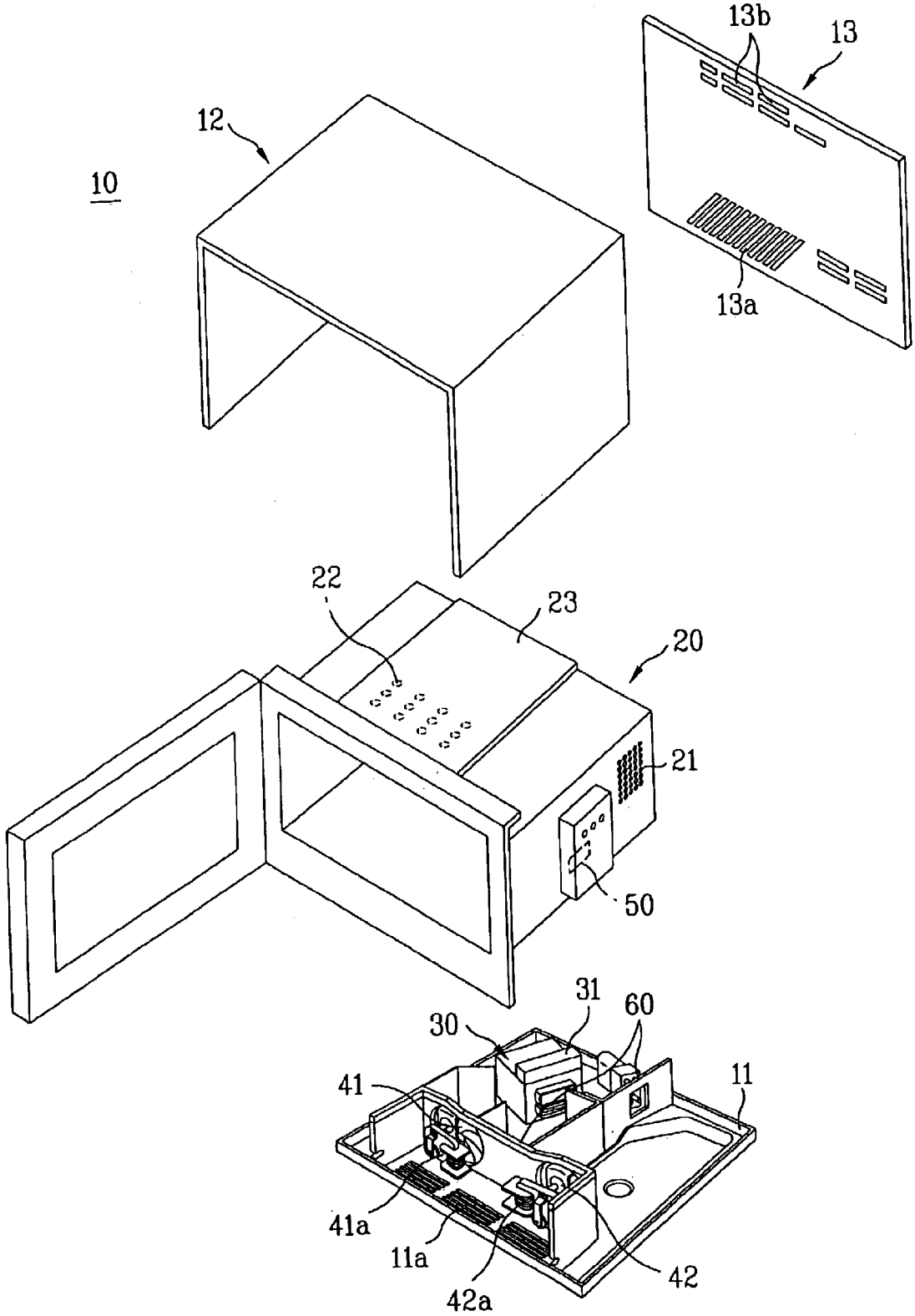
FIG. 1 Prior Art
FIG. 1 illustrates a disassembled perspective view of a related art microwave oven, schematically.
Figure 2:
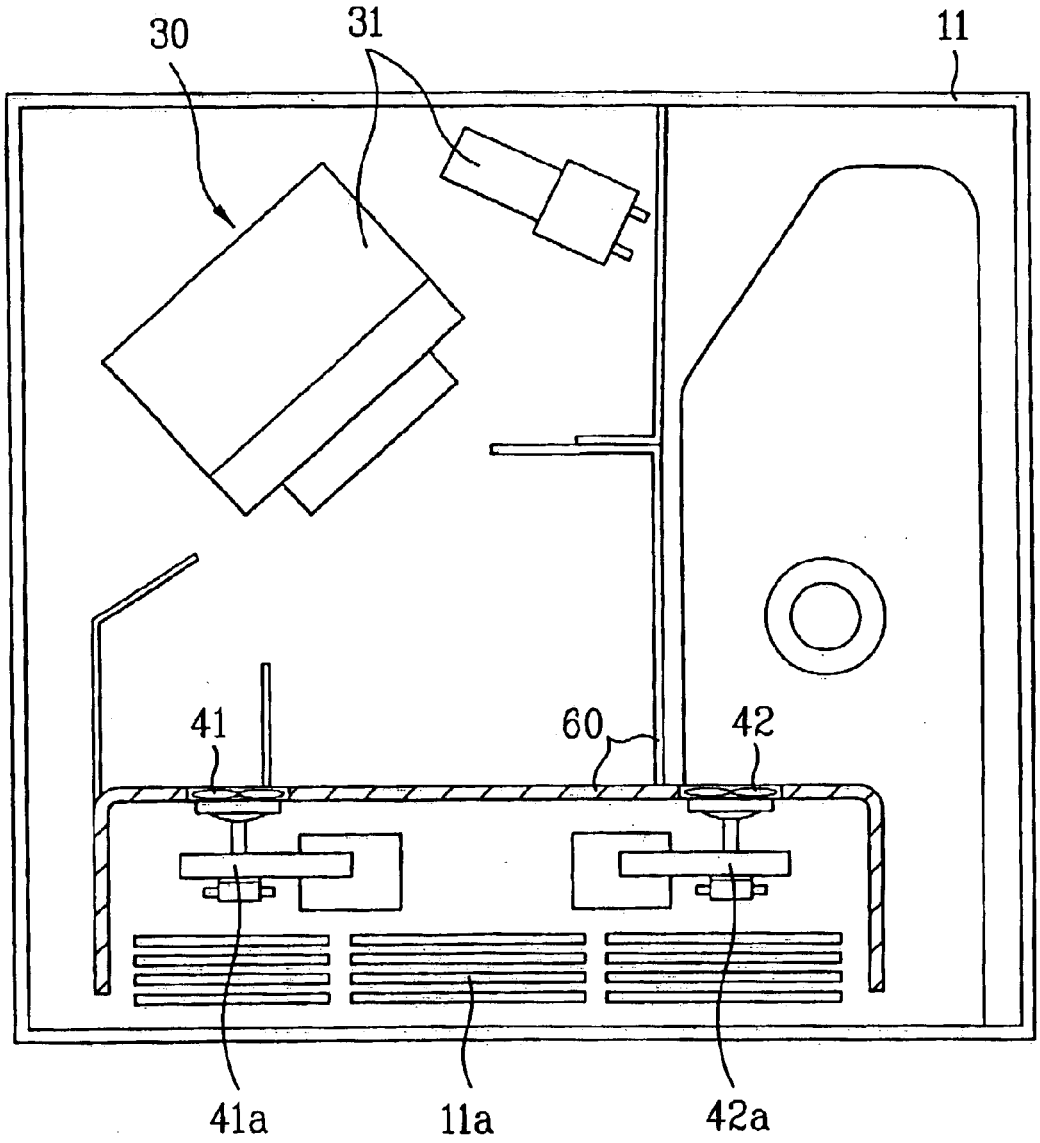
FIG. 2 Prior Art
FIG. 2 illustrates a plan view of a base plate and various components mounted thereon of a related art microwave oven.
Figure 3:
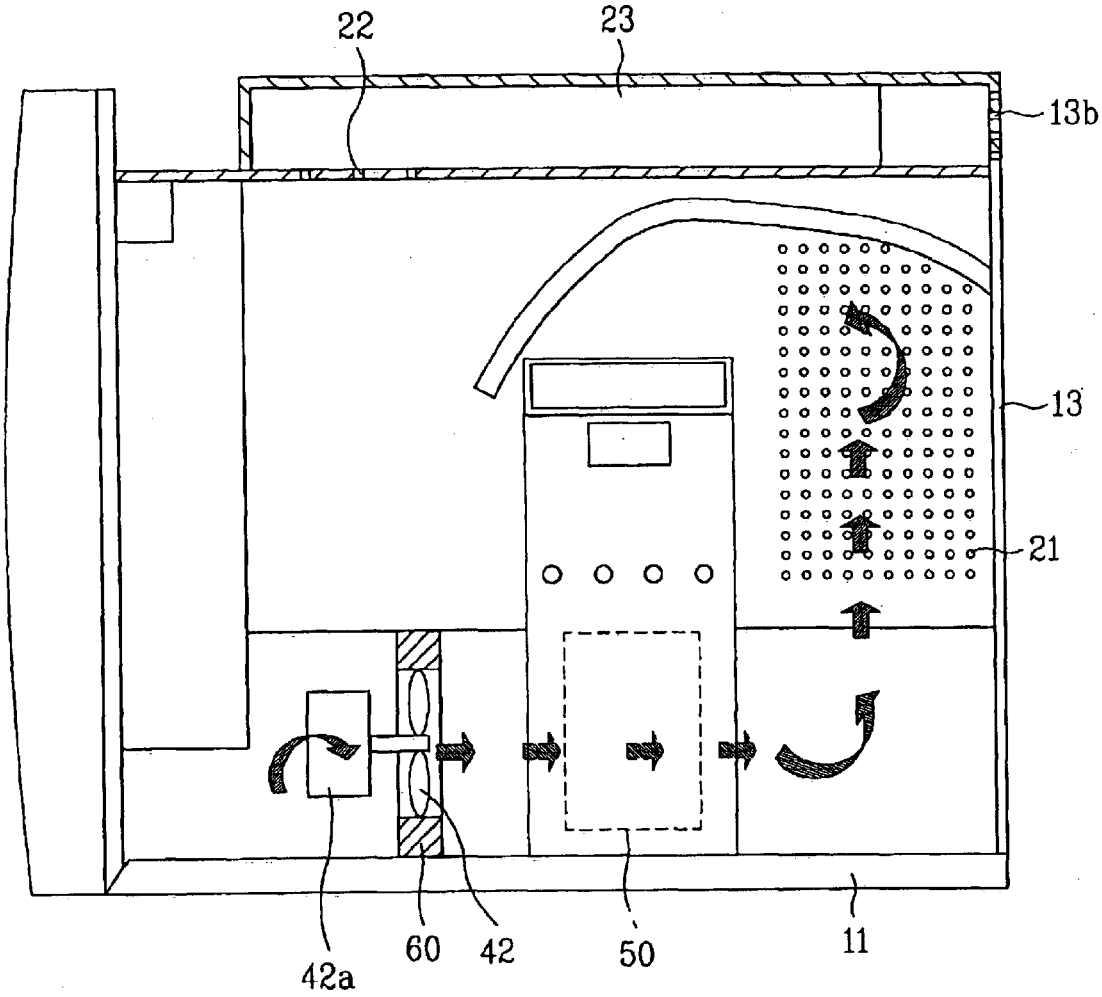
FIG. 3 Prior Art
FIG. 3 illustrates a side view showing an inside of a main cabinet of a related art microwave oven.
Figure 4:
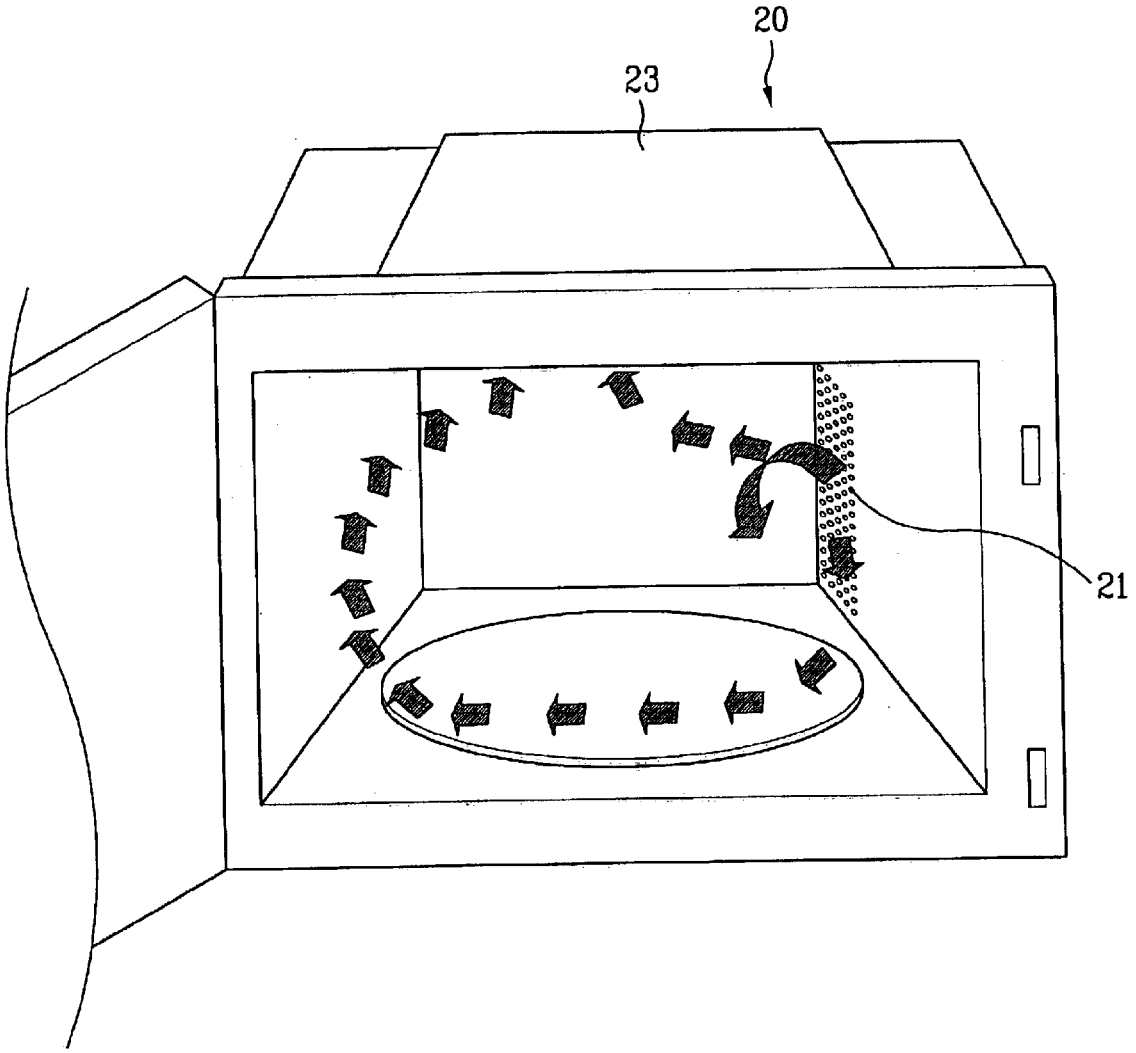
FIG. 4 Prior Art
FIG. 4 illustrates a frontal perspective view showing an inside of a cooling chamber of a related art microwave oven.
Figure 5:
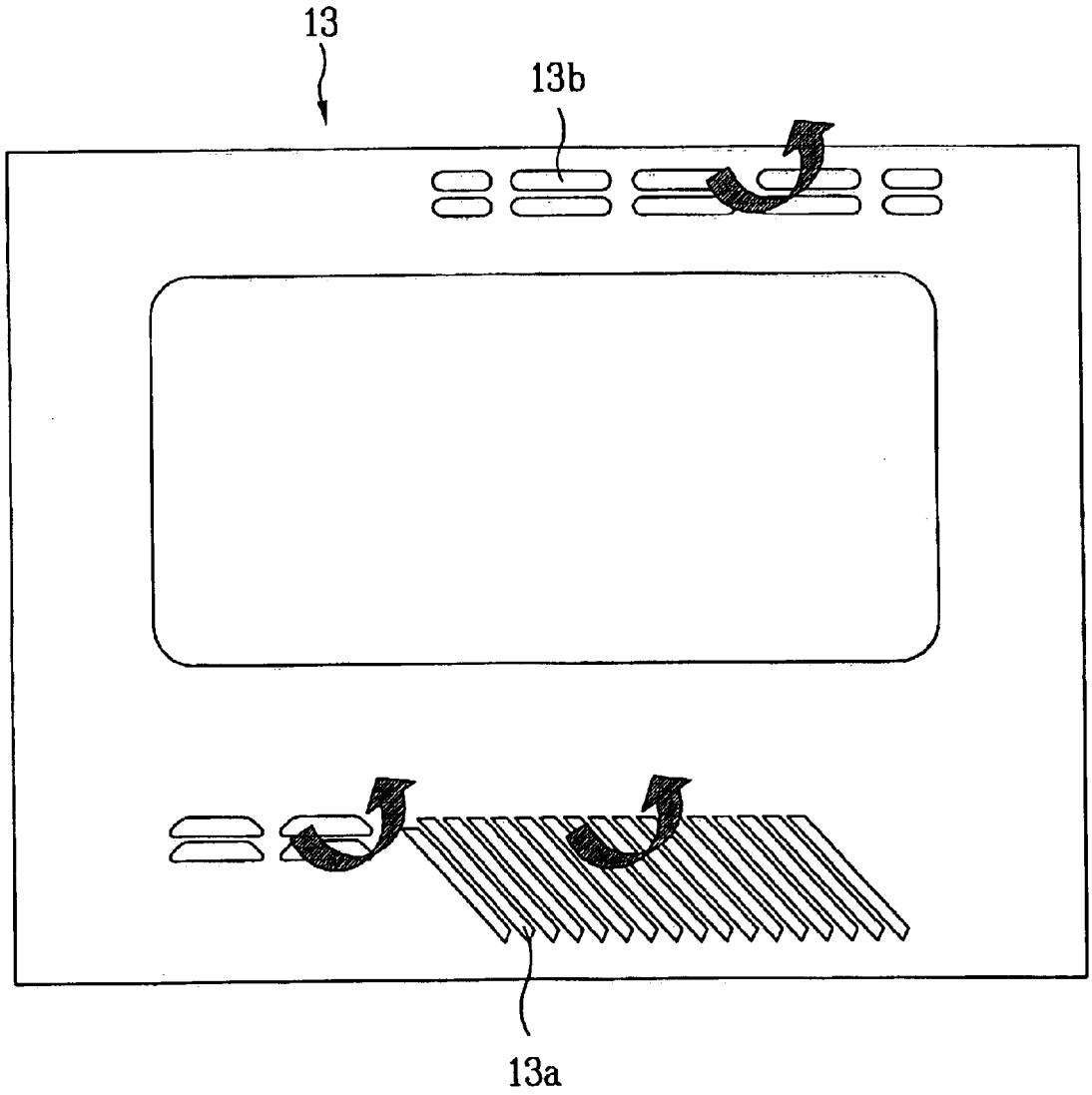
FIG. 5 Prior Art
FIG. 5 illustrates a back view of a related art microwave oven showing a rear panel thereof.
Figure 6:
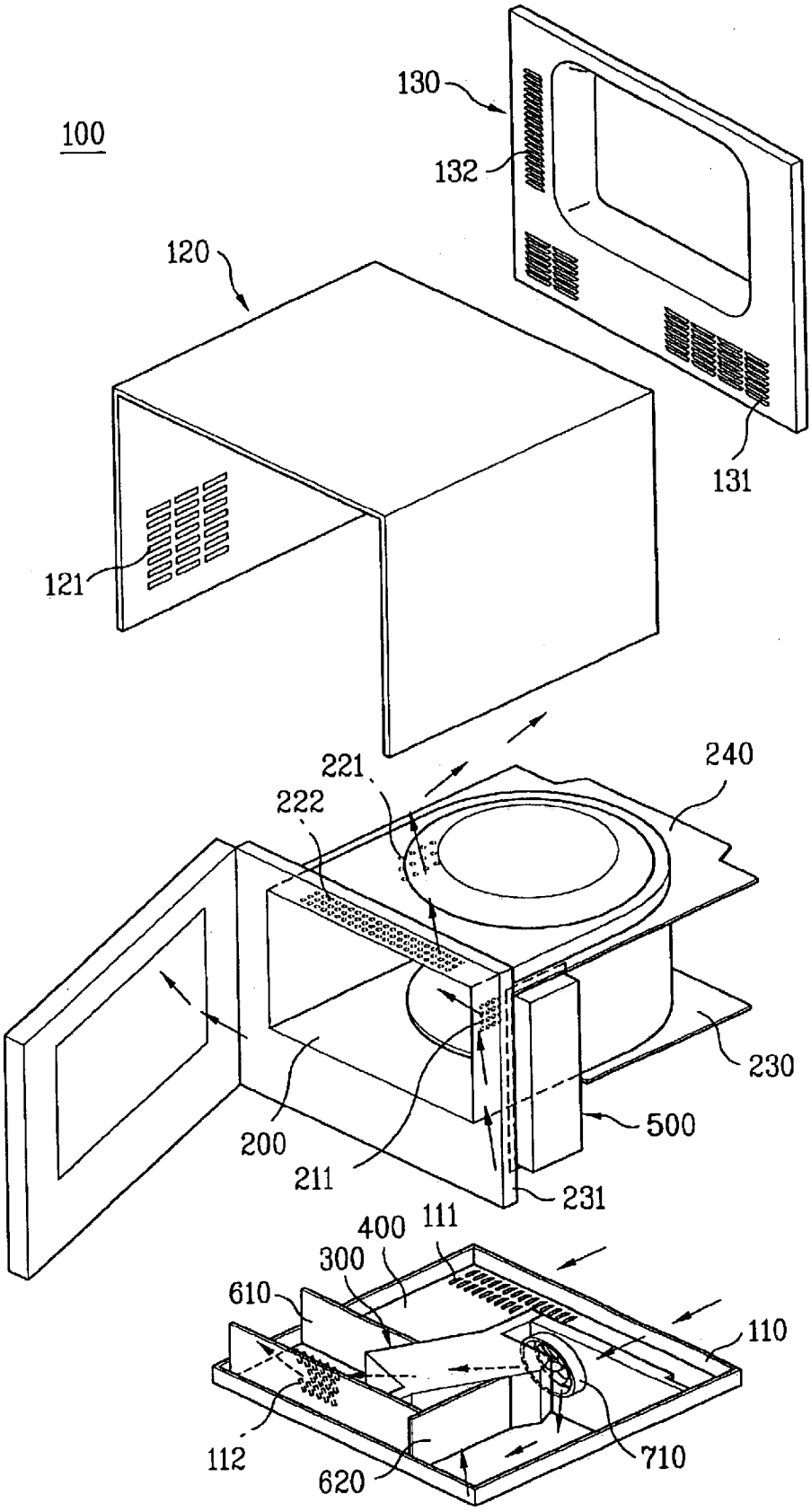
FIG. 6 illustrates a disassembled perspective view of a microwave oven in accordance with a preferred embodiment of the present invention, schematically.

Referring to FIG. 6, the microwave oven of the present invention includes a main cabinet 100, an inner case 200, an inverter part 300, an outfit chamber 400, a magnetron part 500, and a fan device 700.

The main cabinet 100 forms an outer appearance of the microwave oven, and accommodates and protects various components. The main cabinet 100 includes a base plate 110, an outer case 120, a rear panel 130, and a front panel/door (no reference symbol). Along with this, the main cabinet 100 has a plurality of air inlet openings 111 and 131 (hereafter called as first, and second inlet openings) and a plurality of air outlet openings 132 and 121 (hereafter called as first, and second outlet openings).

Referring to FIG. 6, since the outfit chamber 400 is in a rear part of a lower space of the main cabinet, the first and second air inlet openings 111 and 131 are formed in a rear part of the base plate 110 and a lower part of the rear panel 130. At first, external air is introduced into the outfit chamber 400 through the first and second air inlet openings 111 and 131.

The first and second air outlet openings 132 and 121 are in communication with the inner case 200 and the inverter part 300, respectively. That is, the first air outlet openings 132 are formed in an upper part of the rear panel 130 in conformity with a position of the inner case 200. The second air outlet openings 121 are formed in a front part of a side surface of the outer case 120 in conformity with a position of the inverter part 300. According to this, the air having cooled the inner case 200 is discharged through the first air outlet openings 132, and the air having cooled the inverter part 300 is discharged through the second air outlet openings 121.

Figure 10:
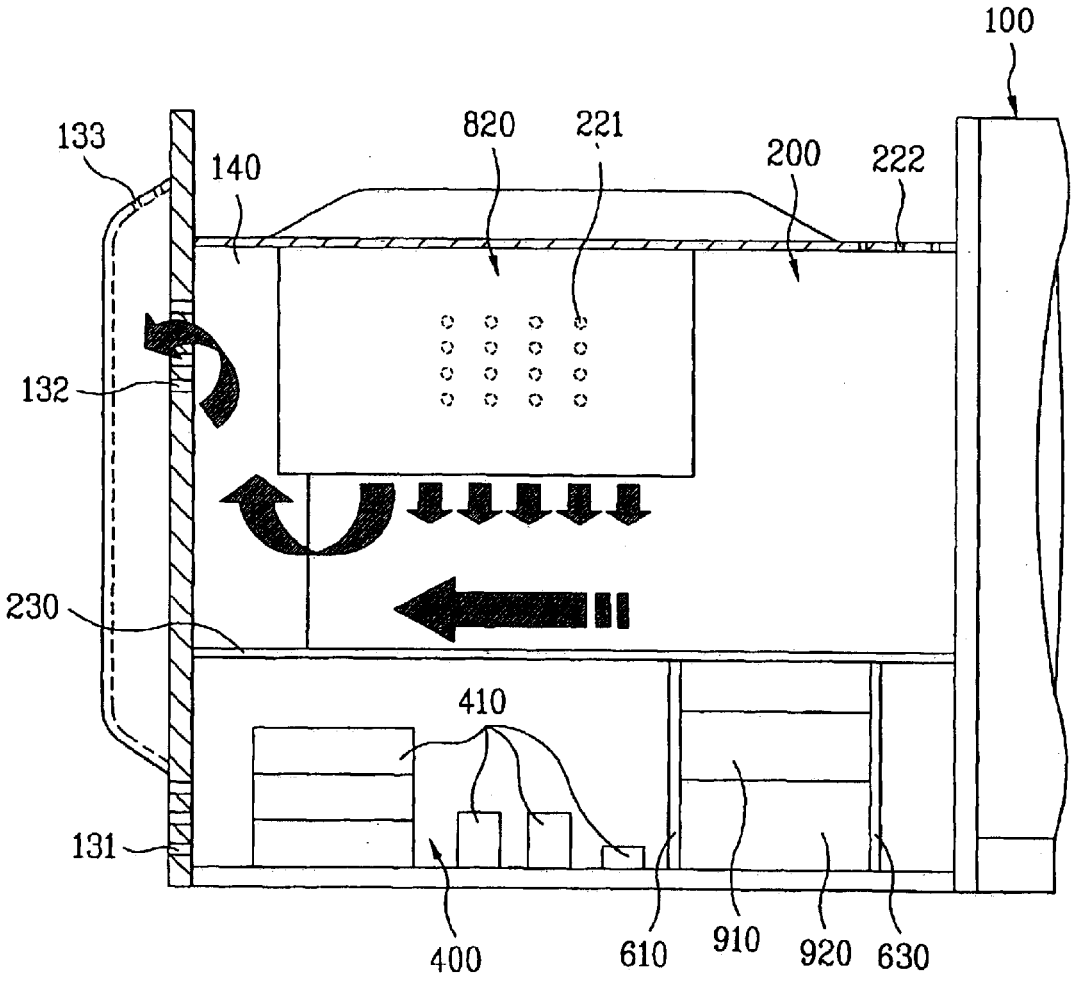
FIG. 10 illustrates a left side view showing an inside of a main cabinet of a microwave oven in accordance with a preferred embodiment of the present invention.
Figure 11:
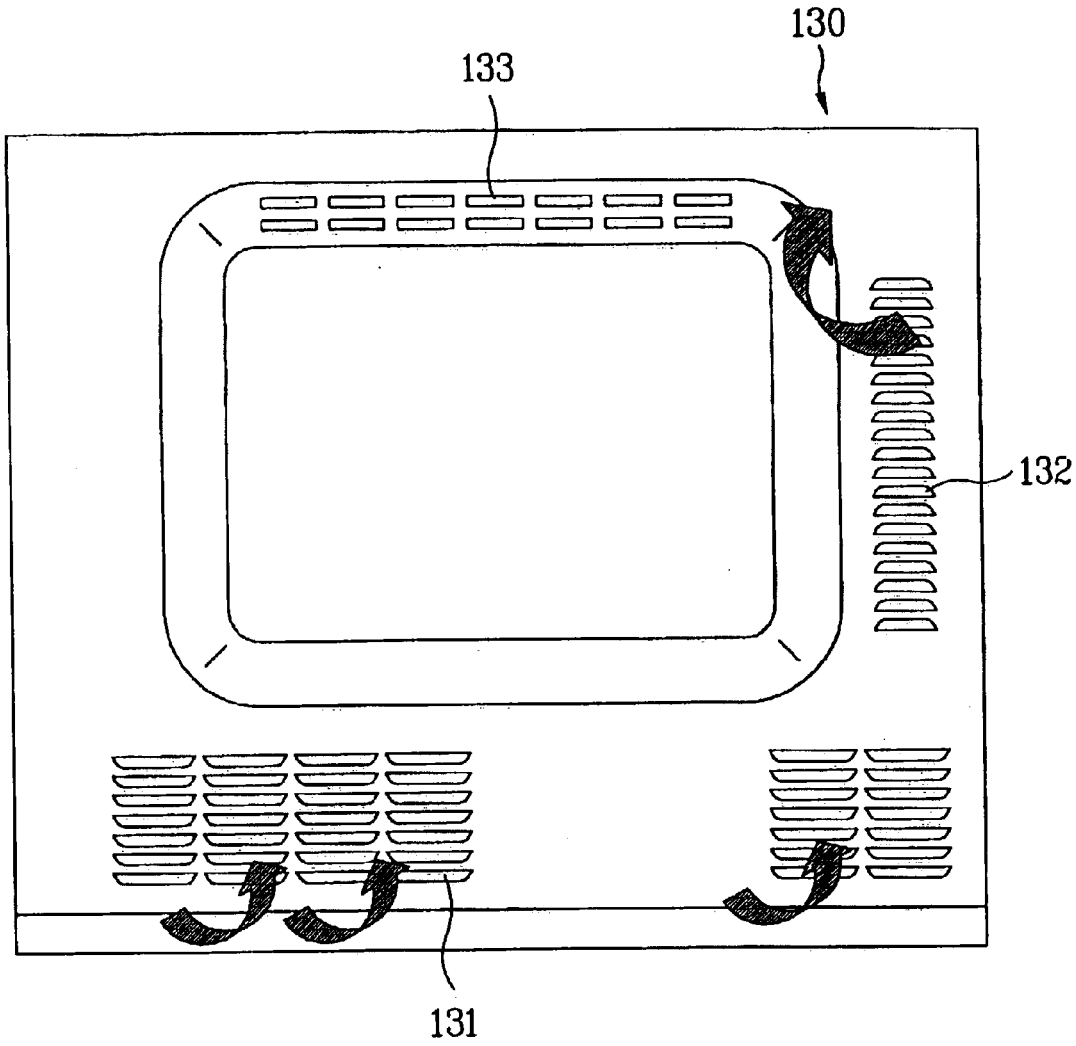
FIG. 11 illustrates a back side view showing a rear panel of a microwave oven in accordance with a preferred embodiment of the present invention.

Referring to FIGS. 10 and 11, the main cabinet 100 further includes third air outlet openings 100 and fourth air outlet openings 133. That is, the third air outlet openings 112 are formed in a front part of the base plate 110 adjacent to the inverter part 300, and the fourth air outlet openings 133 are formed in an upper part of the rear panel 130 adjacent to the inner case 200.

The third air outlet openings 112 are formed for smooth discharge of the air having cooled the inverter part 300 in supplementary to the second air outlet openings 121, and introducing external air toward the inverter part 300. That is, when the fan device 700 stops, more air is introduced through the third air outlet openings 112 owing to a temperature difference between an exterior and interior of the main cabinet 100, which causes a natural convection, and cools down the inverter part 300. Moreover, the air flowing an upper space of the inner case 200 is discharged through the fourth air outlet openings 133.

Referring to FIG. 6, there are inlet holes 211 and outlet holes 221 in opposite sides of the inner case 200. The inlet holes 211 are formed in a front part of a right side of the inner case 200, and the outlet holes (hereafter called as first outlet holes) 221 are formed in a rear part of a left side of the inner case 200. It is preferable that there are additional outlet holes (hereafter called as second outlet holes) 222 in an upper surface of a front part of the inner case 200.

The air having cooled the magnetron 500 is introduced through the inlet holes 211. The air having cooled an inside of the inner case 200 is discharged through the first outlet holes 221, and the air containing moisture is discharged through the second outlet holes 222 for prevention of moisture inside of the inner case 200.

There are a first frame 230 around an outer bottom circumference of the inner case 200, and a second frame 240 around an outer top circumference of the inner case 200. The frames 230 and 240 are projected enough to make a close contact with an inside surface of the outer case 120. The first frame 230 prevents the air flowing under the main cabinet 100 from flowing to an upper space of the main cabinet 100.

Figure 7:
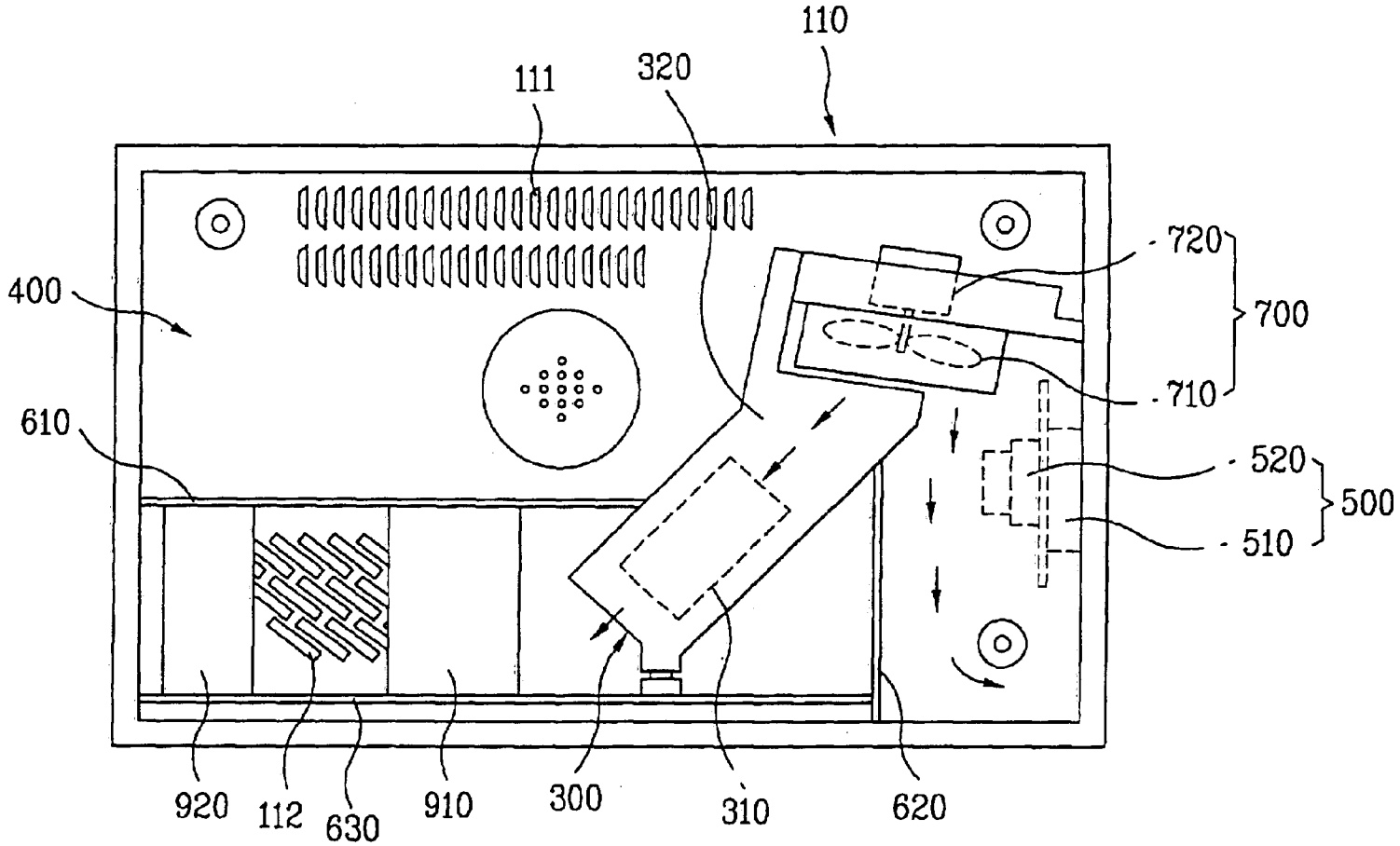
FIG. 7 illustrates a plan view of a base plate and various components mounted thereon of a microwave oven in accordance with a preferred embodiment of the present invention.
Figure 8:
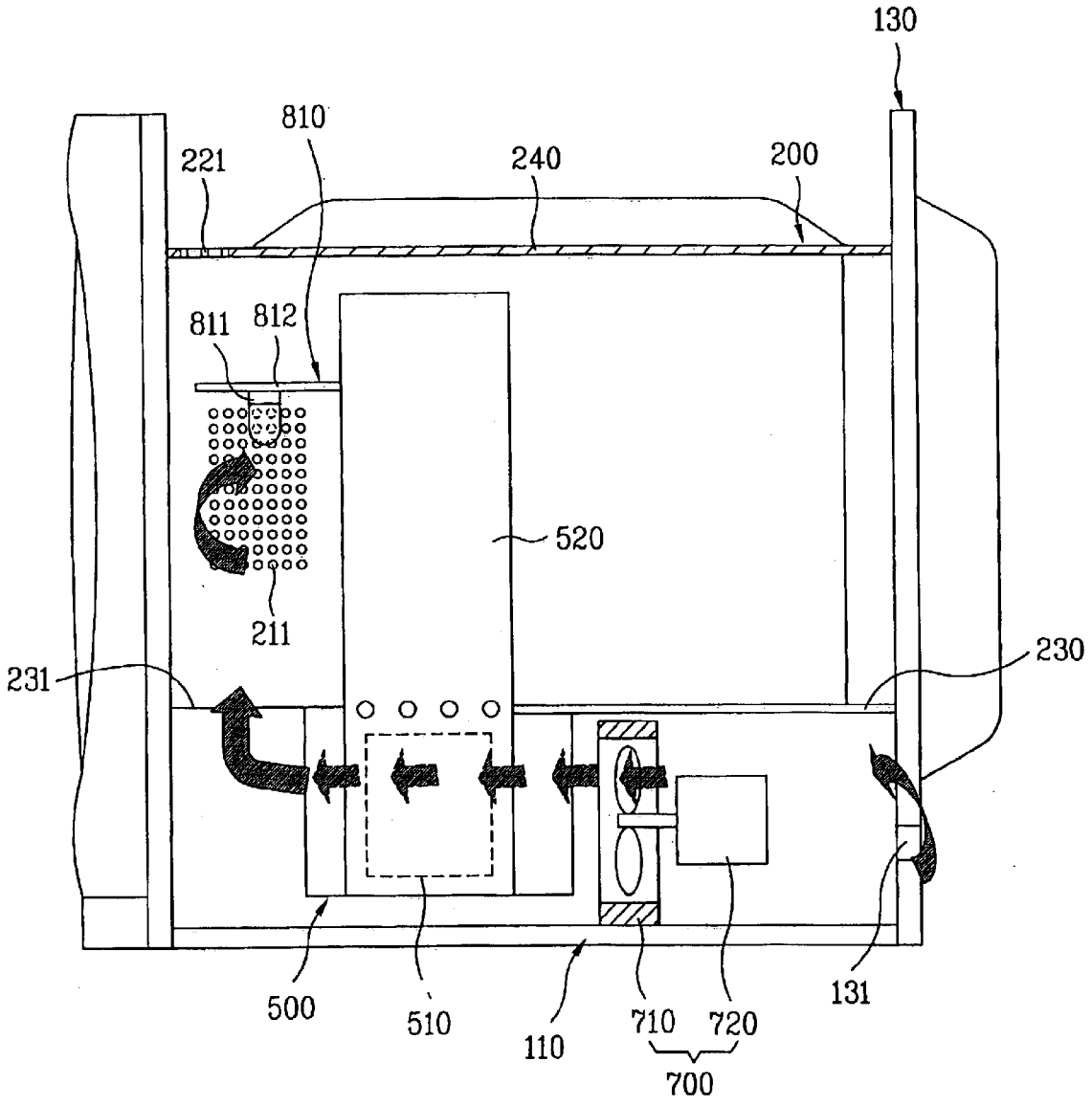
FIG. 8 illustrates a right side view showing an inside of a main cabinet of a microwave oven of the present invention.
Figure 9:
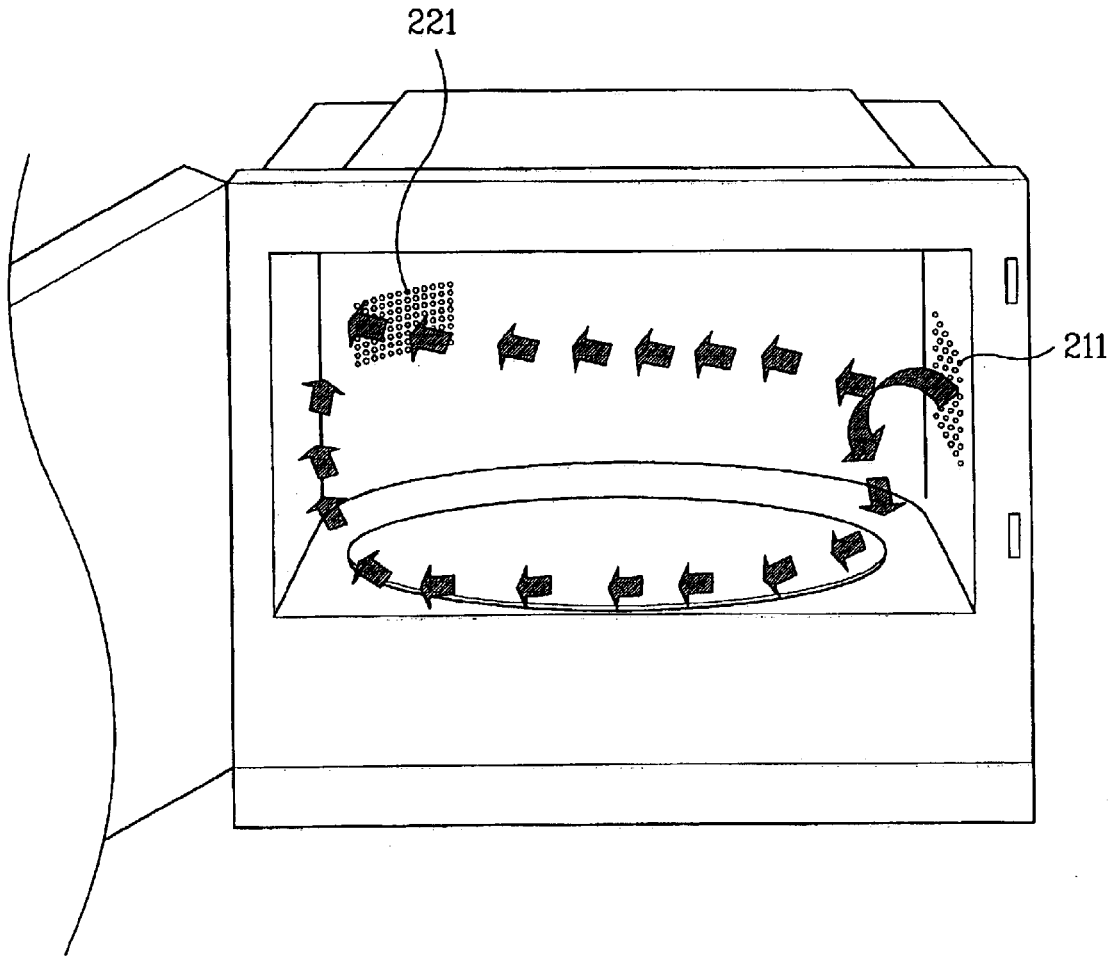
FIG. 9 illustrates a frontal perspective view showing an inside of a cooking chamber of a microwave oven of the present invention.

Referring to FIGS. 7 and 8, for flow of the air passed through the outfit chamber to the inlet holes 211, there is an opening 231 in one side part of the first frame 230. That is, for flow of the air from the lower space of the main cabinet 100 to the upper space of the main cabinet 100, the air is required to pass the opening 231. Also, the first frame 230 makes the air introduced into the main cabinet 100 to be introduced into the inner case 200 after passed through the magnetron part 500, without fail.

In the meantime, the second frame 240 blocks air flow between a side part and the upper part of the inner case 200.

Referring to FIG. 10, there is a shielding plate 140 between the rear panel 130 and the inner case 200, for guiding smooth discharge of the air through the first air outlet openings 132 from the first outlet holes 221.

In the meantime, referring to FIG. 6, the inverter part 300 is provided in a front part of a lower part of the main cabinet 100, and includes an inverter 310. A space having the inverter part 300 provided thereto is in communication with the second air outlet openings and the third air outlet openings 112.

There are various electric components (for an example, a high voltage transformer, a motor for rotating the turn table, and the like) other than the inverter 310 in the outfit chamber in rear of the base plate 110. The outfit chamber 400 is in communication with the first air inlet openings 111 and the second air inlet openings 131.

The magnetron part 500 is provided in a right side space of the main cabinet 100, and includes a conventional magnetron 510 for generating a microwave, and a housing 520 for protecting the magnetron 510. The housing 520 is extended in a height direction to divide a side space between the inner case 200 and the outer case 120 into a front space in communication with the inlet holes 211 in the inner case 200, and a rear space. That is, the housing 520 is in close contact with an outside surface of the inner case and an inside surface of the outer frame 120. The housing 520 is extended to pass through the first frame 230 of the inner case 200 to position a lower end thereof in the lower space of the main cabinet, to form an air flow passage between the housing 520 and the second partition plate 620, and to position an upper end thereof in the upper space to block an air flow. The magnetron 510 is provided to an air flow passage in the lower space of the main cabinet 100.

There are partition plates provided for separating spaces of the inverter part 300, the outfit chamber 400, and the magnetron part 500.

Referring to FIG. 7, the partition plates include a first partition plate 610, and the second partition plate 620.

The first partition plate 610 is formed in a width direction of the base plate 110 for separating a front space (the inverter part space) and a rear space (the outfit chamber). The second partition plate 620 is formed in a length direction to separate the rear space into a left side space (a space of the outfit chamber and the inverter parts) and a right side space (a space for the magnetron part). Moreover, for making the space of the inverter part 300 itself to serve as a flow passage, it is preferable that a third partition plate 630 parallel to the first partition plate 610 is further provided in a rear part of the base plate 110.

There are flow guides 910 and 920 in the space of the inverter part 300, for guiding smooth discharge of the air passed through the inverter 310 through the third air outlet openings 112 and the second air outlet openings 121.

Figure 12A:
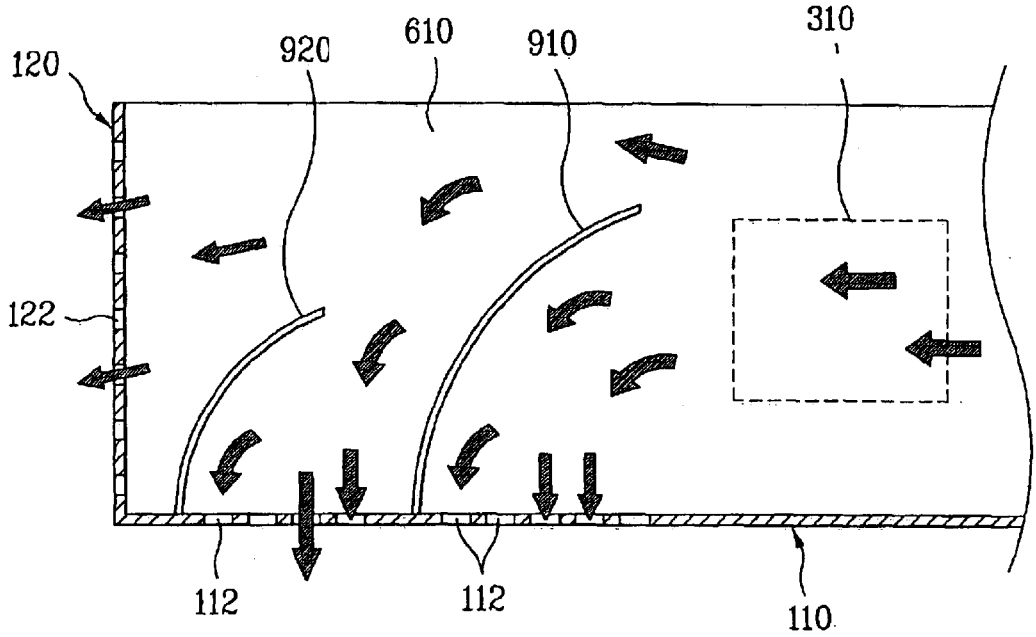
FIGS. 12A and 12B illustrate partial sections each showing air flow guide means in accordance with a preferred embodiment of the present invention.
Figure 12B:
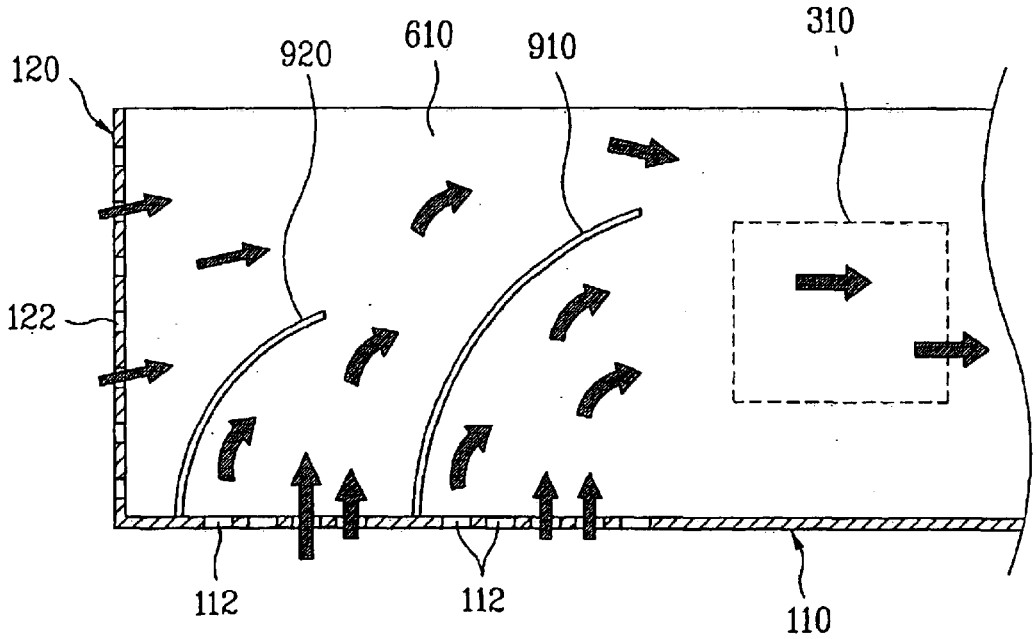

Referring to FIGS. 12A and 12B, the flow guides 910 and 920, formed as a unit with the first partition plate 610 and the third partition plate 630, are sloped so that the air flows toward the third air outlet openings 112. It is preferable that the flow guides 910 and 920 are curved for smooth guide of the air.

Though only one of the flow guides 910 and 920 may be provided, two or more than two can also be provided.

The flow guide (hereafter called as a first flow guide) 910 adjacent to the inverter part 300 has a height higher than the other flow guide (hereafter called as a second flow guide) 920 adjacent to the second air outlet openings 121.

The height of the second flow guide 920 is approx. one half of the height of the first flow guide 910. If three or more than three flow guides are provided, the heights of the flow guides are stepped progressively.

This configuration provides a smooth air flow through the second air outlet openings 121 and the third air outlet openings 112 caused by natural convection coming from a temperature difference between an exterior and interior of the microwave oven when operation of the microwave oven is stopped.

That is, if the height of the second flow guide 920 is the same with the height of the first flow guide 910, since much air flow will be cut-off, to reduce heat dissipation from the inverter 310, the heights of the flow guides 910 and 920 are formed differently.

The fan device 700 of the present invention includes a fan 710 and a fan motor 720, and is provided to a part in communication with all the spaces of the inverter part 300, the outfit chamber 400, and the magnetron 500.

The fan device 700 has an air inlet in communication with the space of the outfit chamber 400, and an air outlet in communication with the space of the inverter part 300 and the space of the magnetron part 500.

It is preferable that an edge of the second partition plate 620 is directed to a center of the fan 710. That is, by making the air flow from the fan 710 divided at the edge of the partition plate 620 into an air flow flowing through the space of the inverter part 300, and an air flow flowing through the space of the magnetron part 500, heat dissipation both from the inverter 310 and the magnetron 510 by using one fan device 700 is made possible.

There is also a lamp part 810 provided in a part of the outside wall surface of the inner case 200 the inlet holes 211 are formed therein. The lamp part 810, provided to illuminate an inside of the inner case selectively, includes a lamp 811, and a lamp holder 812 for holding the lamp 811.

The holder 812 is a plate fixed to an upper part of the inlet holes 211, for smooth guide of the air passed through the magnetron part 500 into an inside of the inner case 200 through the inlet holes 211.

There is a sensor part 820 having a sensor for measuring humidity at a part of the outside wall surface of the inner case 200 the first outlet holes 221 are formed therein. The sensor part 820 measures humidity of the discharged air.

The process of heat dissipation of the present invention will be described in more detail.

When the microwave oven is put into operation, the fan device 700 draws external air and discharges to spaces of the inverter part 300 and the magnetron part 500. The external air is introduced into the main cabinet 100 through the first air inlet openings 111 and the second air inlet opening 131, and divided to flow toward the spaces of the inverter part 300 and the magnetron part 500.

Since the first air inlet openings 111 are in a bottom surface of the base plate 110, at first the external air drawn through the first air inlet openings 111 cools the various electrical components in the outfit chamber 400.

The air, passed through the fan 710 after passed through the foregoing process and discharged to the space of the inverter 300, is guided by a flow passage formed by the first partition plate 610 and the third partition plate 630 to pass the inverter part 300 and cool the inverter 310. Then, the air cooled the inverter 310 is guided by the first flow guide 910 toward the third air outlet openings 112 in the base plate 110, and therefrom discharged to an outside of the main cabinet 100.

In this instance, the air having cooled the inverter 310 is guided along the curved inside surface of the sloped first flow guide 910, which permits a smooth air flow, to permit a smooth discharge of the air through the third air outlet openings 112.

The air having kept flowing without being guided by the first flow guide 910 is in turn guided by the second flow guide 920. The air having kept flowing without being guided by the first or the second flow guide 910 or 920 is discharged through the second air outlet openings 121 in the outer case 120.

In the meantime, the air passed through the fan 710 and discharged to the space of the magnetron part 500 is passed through, and dissipates heat from the magnetron part 500, and is introduced into the upper space through the opening 231 in the first frame 230 of the inner case 200.

In this instance, the air in the lower space can not flow to the upper space through parts other than the opening 231 of the first frame because the parts are blocked by the first frame. The air introduced into a front part of the upper space of the main cabinet 100 can not flow toward a rear part of the upper space of the main cabinet 100 owing to the housing 520 of the magnetron part 500. It is preferable that the fan 710 is discharged to a direction the magnetron 510 is located for smoother heat dissipation from the magnetron 510.

Then, the air is introduced into the inner case 200 through the inlet holes 211 in a state an upper direction flow of the air is blocked by the holder 200 of the lamp part 810. The introduced air circulates the cooking chamber, and is discharged to an outside of the inner case 200 through the first outlet holes 221 and the second outlet holes 222 in the inner case 200.

The second outlet holes 222 prevent a window on a door part 150 in a front face of the microwave oven from wet with moisture. That is, since the second outlet holes 222 are in upper surface of a front part of the inner case 200, the air discharged through the second outlet holes 222 after circulating the cooking chamber can remove the moisture. Then, the air is discharged through the second outlet holes 222 into the upper space of the inner case 200, and therefrom discharged to an outside of the main cabinet 100 through the fourth air outlet openings 133 in the rear panel 130.

The air flowing through the first outlet holes 221 in the inner case 200 passes through the sensor part 820 adjacent to the first outlet holes 221. The sensor in the sensor part 820 for measuring moisture senses an amount of moisture in the air, provides to a controller (not shown), for use in an operation control.

The air is discharged to an outside of the microwave oven through the first air outlet openings 132 in an upper part of a left part of the rear panel 130, after the air flows through the upper space of the main cabinet 100.

The first frame 230 and the second frame 240 separate a space between the inner case 200 and the outer case 120 respectively, thereby preventing introduction of the humid air into the inner case 200 through the first outlet holes 221.

According to this, mix of the humid air passed through the first outlet holes 221 with air in respective spaces of the main cabinet 100, particularly, with the air introduced for heat dissipation from the various components, is prevented.

Above operation is stopped when the fan device is stopped following stop of the microwave oven. When the fan device is stopped, the various electric components, particularly, the inverter 310 for controlling a high power, are heated by heat generated during operation, gradually.

In this instance, referring to FIG. 12B, the air outside of the main cabinet 100 flows toward the space of the inverter part 300 through the second air outlet openings 121 and the third air outlet openings 112 by natural convection caused by a temperature difference between the inverter and the outside of the main cabinet 100.

In above process, the air flowing in a reverse direction through the second air outlet openings 121 flows along curved surfaces of the second flow guide 920 and the first flow guide 910, and dissipates heat from the inverter 310. The air flowing in a reverse direction through the third air outlet openings 112 also dissipates heat from the inverter 310.

Since the second flow guide 920 has a height lower than the first flow guide 910, a smooth reverse flow is possible. Thus, the cooling of the inverter 310 by means of natural convection prevents the inverter from being damaged by overheating.

As has been described, the air circulating structure in a microwave oven of the present invention has the following advantages.

First, the cooling of the outfit chamber and the magnetron with only one cooling fan and a fan motor permits to reduce production cost. This is made possible by forming flow passages for guiding the air from the cooling fan to spaces of the inverter and the magnetron, respectively. The electric components in the outfit chamber require no additional fan device because the electric components are designed to be cooled in a process external air is introduced into the main cabinet by the suction force of the cooling fan.

Second, the positioning of the fan device in the rear part of the main cabinet can prevent direct transmission of noise from the fan device to a user. Moreover, an overall noise can be reduced.

Third, the separation of the lower space external air is introduced in the main cabinet, and the upper space the air is discharged from the main cabinet permits to prevent mixing of the air introduced thereto and the air cooled down the various components, which permits smooth heat dissipation of the various components.

Fourth, the air outlet holes provided adjacent to the inverter permits cooling of the inverter even if the fan is stopped by means of natural convection caused by a temperature difference.

Fifth, the flow guides permit smooth discharge of the air cooled down the inverter, and smooth inflow of external air by means of natural convection when the fan is stopped.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. A microwave oven comprising:

a main cabinet having a plurality of air inlet openings and a plurality of air outlet openings, for accommodating and protecting various components;

an inner case provided in an upper space of the main cabinet to form a cooking chamber therein, the inner case having a plurality of inlet holes and outlet holes;

an outfit chamber in a rear part of a lower space of the main cabinet for fitting electronic components therein;

an inverter part in a front part of a lower space of the main cabinet;

a magnetron part in a side space of the main cabinet;

partition plates for separating a space for the inverter part, a space of the outfit chamber, and a space for the magnetron, respectively; and a single fan device in a part in contact with the spaces in common for circulating external air to the spaces in the main cabinet.

2. The microwave oven as claimed in claim 1, wherein the air inlet openings are formed in a bottom surface, and a rear surface of a rear part of the main cabinet.

3. The microwave oven as claimed in claim 2, wherein the air inlet openings are in communication with the outfit chamber.

4. The microwave oven as claimed in claim 3, wherein the air inlet openings are a plurality of slits.

5. The microwave oven as claimed in claim 1, wherein the air outlet openings are formed in a rear surface of the main cabinet.

6. The microwave oven as claimed in claim 5, wherein the air outlet openings are formed adjacent to the outlet holes in the inner case.

7. The microwave oven as claimed in claim 6, further comprising a frame between the rear surface of the main cabinet and the inner case for prevention of re-introduction of the air passed through the outlet holes into an inside of the main cabinet.

8. The microwave oven as claimed in claim 1, wherein the air outlet openings are formed in a side surface of the main cabinet.

9. The microwave oven as claimed in claim 1, wherein the air outlet openings are formed to be in communication with the inverter part.

10. The microwave oven as claimed in claim 1, wherein the air outlet openings are formed in a side surface of front part of the main cabinet.

11. The microwave oven as claimed in claim 1, wherein the inlet holes in the inner case are formed to be in communication with the space for the magnetron part.

12. The microwave oven as claimed in claim 11, wherein the inlet holes in the inner case are formed in a side wall surface of the inner case adjacent to the space for the magnetron part.

13. The microwave oven as claimed in claim 12, further comprising a lamp part in a part the inlet holes are formed therein for illuminating an inside of the inner case.

14. The microwave oven as claimed in claim 13, wherein the lamp part includes:

a lamp; and a holder for holding the lamp and guiding the air to the inlet holes.

15. The microwave oven as claimed in claim 1, wherein the inner case further includes supplementary outlet holes in an upper surface of the inner case.

16. The microwave oven as claimed in claim 15, further comprising air outlet openings in an upper surface of rear part of the main cabinet for discharging the air discharged through the supplementary outlet holes.

17. The microwave oven as claimed in claim 1, further comprising a frame projected from a bottom circumference of the inner case and configured to horizontally separate a space of the main cabinet into a lower space and an upper space.

18. The microwave oven as claimed in claim 17, wherein the frame has an opening in a part adjacent to the inlet holes in the inner case.

19. The microwave oven as claimed in claim 1, further comprising a frame projected from a top circumference of the inner case to form a space between the main cabinet and the inner case.

20. The microwave oven as claimed in claim 1, further comprising a sensor part provided to the outlet holes for detecting a moisture content of outlet air.

21. The microwave oven as claimed in claim 1, wherein the magnetron part includes:

a magnetron for emitting a microwave; and a housing projected toward a side surface of the main cabinet for protecting the magnetron and separating a side space of the main cabinet into a front space in communication with the inlet holes in the inner case and a rear space.

22. The microwave oven as claimed in claim 21, wherein the housing blocks a gap between a sidewall of the inner case and a sidewall of the main cabinet.

23. The microwave oven as claimed in claim 1, wherein the fan device includes:

a fan for blowing air to the space for the inverter part and the space for the magnetron at the same time; and a fan motor for driving the fan.

24. The microwave oven as claimed in claim 23, wherein the fan is located in a rear part of the lower space of the main cabinet.

25. The microwave oven as claimed in claim 23, wherein the fan blows air both to the space for the inverter and the space for magnetron, partially.

26. The microwave oven as claimed in claim 1, wherein the partition plates include:

a first partition plate provided in a width direction to separate the space for the inverter part and the space of the outfit chamber; and a second partition plate provided in a length direction to partition the space for the magnetron.

27. The microwave oven as claimed in claim 26, wherein the partition plates further include a third partition plate provided in parallel to the first partition plate for forming an air passage to the space for the inverter part.

28. The microwave oven as claimed in claim 26, wherein the fan is provided proximate an area where the first and second partition plates cross.

29. The microwave oven as claimed in claim 26, further comprising a flow guide formed in the space for the inverter part for guiding an air flow.

30. The microwave oven as claimed in claim 29, wherein an air discharge passage from the inverter part includes air outlet openings in a bottom surface of a front part of the main cabinet, and the flow guide is sloped for guiding air flow to the air outlet openings.

31. The microwave oven as claimed in claim 30, wherein the flow guide has a predetermined curvature.

32. The microwave oven as claimed in claim 31, wherein a plurality of flow guides are provided.

33. The microwave oven as claimed in claim 32, wherein the flow guides have different heights.

34. The microwave oven as claimed in claim 33, wherein the heights of the become lower as they approach an area proximate the inverter part.

35. The microwave oven as claimed in claim 34, wherein the air discharge passage from the inverter part further includes air outlet openings in a side surface of a front part of the main cabinet.

* * * * *